US010946686B2

(12) United States Patent
LeStrange et al.

(10) Patent No.: US 10,946,686 B2
(45) Date of Patent: Mar. 16, 2021

(54) FOUNTAIN SOLUTION DEPOSITION APPARATUS AND METHOD FOR DIGITAL PRINTING DEVICE

(71) Applicant: Xerox Corporation, Norwalk, CT (US)

(72) Inventors: Jack T. LeStrange, Macedon, NY (US); Peter J. Knausdorf, Henrietta, NY (US); Joseph C. Sheflin, Macedon, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 16/943,488

(22) Filed: Jul. 30, 2020

(65) Prior Publication Data

US 2020/0353769 A1 Nov. 12, 2020

Related U.S. Application Data

(63) Continuation of application No. 15/962,063, filed on Apr. 25, 2018.

(51) Int. Cl.

| | |
|---|---|
| ***B41N 3/08*** | (2006.01) |
| ***B41M 1/06*** | (2006.01) |
| ***B41F 31/18*** | (2006.01) |
| ***B41F 7/02*** | (2006.01) |

(52) U.S. Cl.

CPC ..... *B41N 3/08* (2013.01); *B41F 7/02* (2013.01); *B41F 31/18* (2013.01); *B41M 1/06* (2013.01); *B41P 2200/22* (2013.01)

(58) Field of Classification Search

CPC ..... B41N 3/08

USPC ..... 101/141

See application file for complete search history.

(56) References Cited

U.S. PATENT DOCUMENTS

| | | | | |
|---|---|---|---|---|
| 3,630,149 | A * | 12/1971 | Etter | B41L 19/00 101/450.1 |
| 3,741,118 | A | 6/1973 | Carley | |
| 3,800,699 | A | 4/1974 | Carley | |
| 5,188,032 | A | 2/1993 | Lewis et al. | |
| 8,256,346 | B2 * | 9/2012 | Lewis | B41M 1/06 101/450.1 |
| 8,950,322 | B2 * | 2/2015 | Liu | B41C 1/1033 101/147 |
| 8,991,310 | B2 | 3/2015 | Stowe et al. | |
| 9,021,949 | B2 * | 5/2015 | Biegelsen | B41C 1/10 101/148 |

(Continued)

*Primary Examiner* — Anthony H Nguyen

(74) *Attorney, Agent, or Firm* — Caesar Rivise, PC

(57) ABSTRACT

An intermediate roller positioned between a fountain solution vapor supply and an imaging member decouples fountain solution vapor deposition from the surface of the imaging member. The intermediate roller may be temperature controlled. A uniform layer of fountain solution condenses onto the surface of the temperature controlled intermediate roller regardless of the imaging blanket temperature. The fountain solution condensate layer deposited onto the intermediate roller splits and deposits a thin uniform layer of fountain solution liquid onto the imaging member surface. This liquid layer split may be independent of the temperature of the imaging member surface, resulting in a uniform layer of fountain solution on the imaging blanket for better imaging quality. Remotely locating the vaporizing chamber away from the imaging member prevents undesired heat transfer from a hot vaporizing chamber/baffle to the imaging member surface.

20 Claims, 3 Drawing Sheets

(56) References Cited

U.S. PATENT DOCUMENTS

| | | | | |
|---|---|---|---|---|
| 2002/0056388 | A1* | 5/2002 | Makino | B41C 1/1025 101/453 |
| 2005/0115429 | A1 | 6/2005 | Link | |
| 2010/0077932 | A1* | 4/2010 | Pekurovsky | B41F 5/24 101/141 |
| 2011/0088576 | A1* | 4/2011 | Fromson | B41C 1/1075 101/141 |
| 2012/0103212 | A1 | 5/2012 | Stowe et al. | |
| 2013/0036927 | A1* | 2/2013 | Lewis | B41C 1/1033 101/450.1 |
| 2013/0087167 | A1 | 4/2013 | Chopra et al. | |
| 2013/0247788 | A1 | 9/2013 | Liu et al. | |
| 2015/0083006 | A1 | 3/2015 | Abergel et al. | |

* cited by examiner

FOUNTAIN SOLUTION DEPOSITION APPARATUS AND METHOD FOR DIGITAL PRINTING DEVICE

CROSS REFERENCE TO RELATED APPLICATIONS

This application is a Continuation of U.S. patent application Ser. No. 15/962,063, filed Apr. 25, 2018, entitled "Fountain Solution Deposition Apparatus and Method for Digital Printing Device".

FIELD OF DISCLOSURE

This invention relates generally to digital printing systems, and more particularly, to fountain solution deposition systems and methods for use in lithographic offset printing systems.

BACKGROUND

Ink-based digital printing systems are variable data lithography systems configured for digital lithographic printing that may include an imaging member having a reimageable surface layer, such as a silicone-containing surface layer. In digital offset lithographic printing systems, a dampening system applies a thin layer of fountain solution onto the reimageable surface layer of a digital offset imaging plate. An imaging system then evaporates the fountain solution film in an image area using a high power laser. A latent image is formed on the surface of the digital offset imaging plate. The latent image corresponds to a pattern of the applied fountain solution that is left over after evaporation.

An inking system may be used to apply a uniform layer of ink over a surface layer of the imaging plate. Typically, ink supplied on an inker form roll of the inking system is depleted from the form roll as the ink is transferred from the form roll onto the imaging plate. As a portion of the imaging plate surface containing the latent image passes through the inking system, the ink deposits onto the plate regions where the laser has vaporized the fountain solution. Conversely, ink is rejected by the plate regions where fountain solution remains. The resulting ink image is then transferred to paper or other print media via pressure. Such systems are disclosed in U.S. Publication No. US 2012/0103212A1 ("212 Publication"), entitled "Variable Data Lithography System," filed on Apr. 27, 2011, by Timothy Stowe et al., which is commonly assigned.

SUMMARY

The following presents a simplified summary in order to provide a basic understanding of some aspects of one or more embodiments or examples of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later. Additional goals and advantages will become more evident in the description of the figures, the detailed description of the disclosure, and the claims.

The foregoing and/or other aspects and utilities embodied in the present disclosure may be achieved by providing a fountain solution deposition system useful for printing with an ink-based digital image forming apparatus having a rotatable imaging member with a reimageable surface. The exemplary fountain solution deposition system includes a donor roller, a vapor supply chamber, a vapor supply chamber outlet, and a vapor baffle. The donor roller may have a surface in rolling communication with the reimageable surface of the rotatable imaging member. The vapor supply chamber defines a vapor supply chamber interior in fluid communication with a fountain solution vapor source. The vapor supply chamber descends towards the donor roller to deliver fountain solution vapor from the vapor source towards the surface of the donor roller. The vapor supply chamber outlet is configured to enable the vapor supply chamber interior to communicate with the surface of the donor roller. The vapor baffle may be in contact with the vapor supply chamber and extend about the donor roller surface downstream the vapor supply chamber in a rotating direction of the donor roller. The vapor baffle defines a vapor flow channel with the donor roller surface to confine the fountain solution vapor to a condensation region between the vapor baffle and the donor roller surface to support forming a liquid layer of fountain solution on the donor roller surface via condensation of the fountain solution vapor over the donor roller surface. The donor roller is configured to transfer the liquid layer of fountain solution from the donor roller surface to the reimageable surface of the rotatable imaging member. The system may also include a vapor reclaim vacuum having a vapor collection manifold downstream the vapor baffle in a rotating direction of the donor roller, the vapor reclaim vacuum configured to remove vapor downstream the condensation region.

According to aspects illustrated herein, an exemplary fountain solution deposition method for depositing a condensate layer of fountain solution onto a reimageable surface of a rotatable imaging member useful for printing with an ink-based digital image forming apparatus may include steps of delivering fountain solution vapor from a fountain solution vapor source towards a surface of a donor roller in rolling communication with the reimageable surface of the rotatable imaging member via a vapor supply chamber defining a vapor supply chamber interior in fluid communication with the fountain solution vapor source, the vapor supply chamber descending towards the donor roller, providing a vapor supply chamber outlet adjacent the donor roller surface to enable vapor communication between the vapor supply chamber interior and the donor roller surface, confining the fountain solution vapor to a condensation region adjacent the donor roller surface with a vapor baffle in contact with the vapor supply chamber and extending about the donor roller surface downstream the vapor supply chamber in a rotating direction of the donor roller, the confined fountain solution vapor condensing to the liquid layer of fountain solution on the donor roller surface at the condensation region, and transferring the condensate layer of fountain solution from the donor roller surface to the reimageable surface of the rotatable imaging member.

According to aspects described herein, a fountain solution deposition system useful for printing with an ink-based digital image forming apparatus may include a rotatable imaging member, a donor roller, a vapor supply chamber, a vapor supply chamber outlet, a heater and a vapor baffle. The rotatable imaging member may include a reimageable surface. The donor roller may have a surface in rolling communication with the reimageable surface of the rotatable imaging member. The vapor supply chamber may define a vapor supply chamber interior in fluid communication with a vapor source, the vapor supply chamber descending towards the donor roller, the vapor supply chamber being configured to deliver vapor from the fountain solution vapor source towards the surface of the donor roller. The vapor supply chamber outlet may be configured to enable the vapor supply chamber interior to communicate with the surface of the donor roller. The vapor baffle may be in contact with the vapor supply chamber and extend about the donor roller surface downstream the vapor supply chamber in a rotating direction of the donor roller to define a vapor flow channel with the donor roller surface that confines the fountain solution vapor to a condensation region between the vapor baffle and the donor roller surface to support forming a liquid layer of fountain solution on the donor roller surface via condensation of the fountain solution vapor over the donor roller surface. The donor roller may be configured to transfer the condensate layer of fountain solution from the donor roller surface to the reimageable surface of the rotatable imaging member, wherein the fountain solution vapor passes through a heated vapor supply chamber and the vapor baffle prior to condensation of the vapor over the donor roller surface. The heater is configured to heat the vapor baffle.

Exemplary embodiments are described herein. It is envisioned, however, that any system that incorporates features of apparatus and systems described herein are encompassed by the scope and spirit of the exemplary embodiments.

BRIEF DESCRIPTION OF THE DRAWINGS

Various exemplary embodiments of the disclosed apparatuses, mechanisms and methods will be described, in detail, with reference to the following drawings, in which like referenced numerals designate similar or identical elements, and.

DETAILED DESCRIPTION

Figure 1:
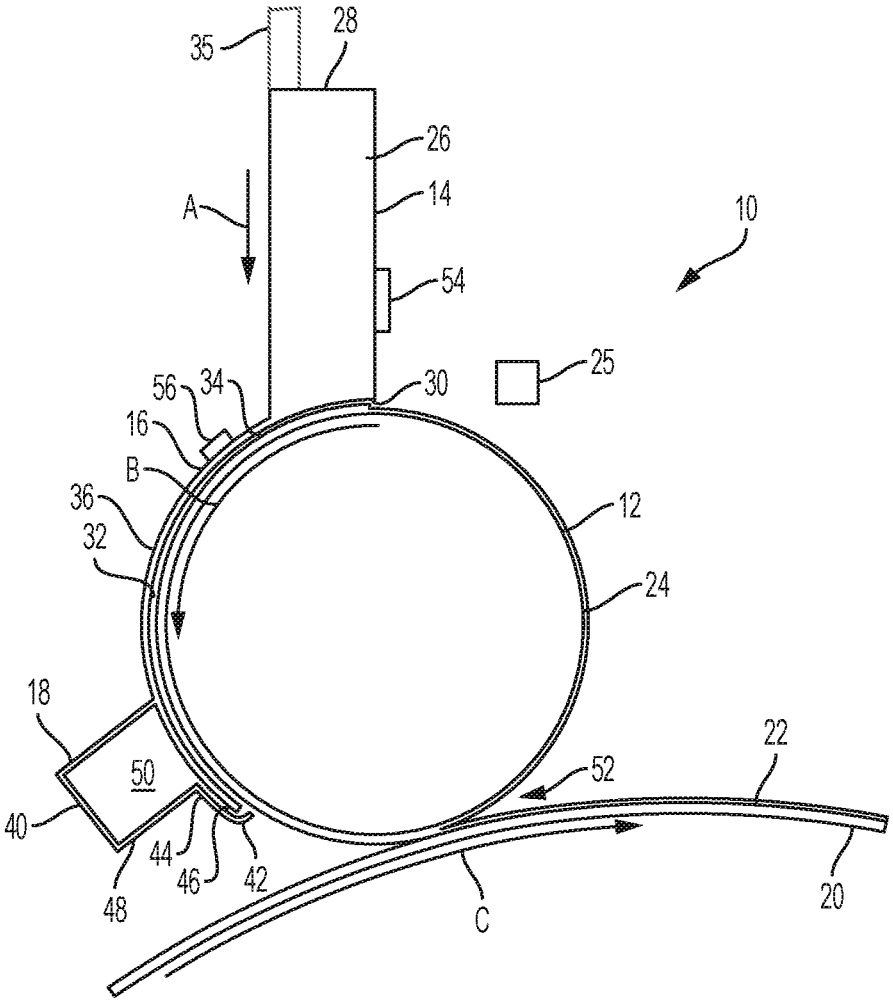
FIG. 1 is a side view, partially in cross, of a fountain solution deposition system in accordance with an example of the embodiments.

Illustrative examples of the devices, systems, and methods disclosed herein are provided below. An embodiment of the devices, systems, and methods may include any one or more, and any combination of, the examples described below. This invention may, however, be embodied in many different forms and should not be construed as limited to the embodiments set forth below. Rather, these exemplary embodiments are provided so that this disclosure will be thorough and complete, and will fully convey the scope of the invention to those skilled in the art. Accordingly, the exemplary embodiments are intended to cover all alternatives, modifications, and equivalents as may be included within the spirit and scope of the apparatuses, mechanisms and methods as described herein.

We initially point out that description of well-known starting materials, processing techniques, components, equipment and other well-known details may merely be summarized or are omitted so as not to unnecessarily obscure the details of the present disclosure. Thus, where details are otherwise well known, we leave it to the application of the present disclosure to suggest or dictate choices relating to those details. The drawings depict various examples related to embodiments of illustrative methods, apparatus, and systems for inking from an inking member to the reimageable surface of a digital imaging member.

When referring to any numerical range of values herein, such ranges are understood to include each and every number and/or fraction between the stated range minimum and maximum. For example, a range of 0.5-6% would expressly include the endpoints 0.5% and 6%, plus all intermediate values of 0.6%, 0.7%, and 0.9%, all the way up to and including 5.95%, 5.97%, and 5.99%. The same applies to each other numerical property and/or elemental range set forth herein, unless the context clearly dictates otherwise.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value. For example, the term "about 2" also discloses the value "2" and the range "from about 2 to about 4" also discloses the range "from 2 to 4."

The terms "media", "print media", "print substrate" and "print sheet" generally refers to a usually flexible physical sheet of paper, polymer, Mylar material, plastic, or other suitable physical print media substrate, sheets, webs, etc., for images, whether precut or web fed. The listed terms "media", "print media", "print substrate" and "print sheet" may also include woven fabrics, non-woven fabrics, metal films, and foils, as readily understood by a skilled artisan.

The term "printing device" or "printing system" as used herein may refer to a digital copier or printer, scanner, image printing machine, xerographic device, electrostatographic device, digital production press, document processing system, image reproduction machine, bookmaking machine, facsimile machine, multi-function machine, or generally an apparatus useful in performing a print process or the like and can include several marking engines, feed mechanism, scanning assembly as well as other print media processing units, such as paper feeders, finishers, and the like. A "printing system" may handle sheets, webs, substrates, and the like. A printing system can place marks on any surface, and the like, and is any machine that reads marks on input sheets; or any combination of such machines.

Inking systems or devices may be incorporated into a digital offset image forming architecture so that the inking system is arranged about a central imaging plate, also referred to as an imaging member. The imaging member may be a cylinder or drum. A surface of the imaging member is reimageable making the imaging member a digital imaging member. The surface is also conformable. The conformable surface may comprise, for example, silicone. A paper path architecture may be situated about the imaging member to form a media transfer nip.

A layer of fountain solution may be applied to a surface of the central imaging plate by a dampening system. In a digital evaporation step, particular portions of the fountain solution layer applied to the surface of the central imaging plate may be evaporated by a digital evaporation system. For example, portions of the fountain solution layer may be vaporized by laser patterning to form a latent image. In a vapor removal step, the vaporized fountain solution may be collected by a vapor removal device to prevent condensation of the vaporized fountain solution back onto the imaging plate.

In an inking step, ink may be transferred from an inking system to the surface of the central imaging plate, also referred to as the surface or blanket of the imaging member. The transferred ink adheres to portions of the surface of the imaging member where fountain solution has been evaporated. In an image transfer step, the transferred ink may be transferred to media such as paper at a media transfer nip.

In a variable lithographic printing process, previously imaged ink must be removed from the imaging member to prevent ghosting. After an image transfer step, the surface of the imaging member may be cleaned by a cleaning system. For example, tacky cleaning rollers may be used to remove residual ink and fountain solution from the surface of the imaging member.

A drawback to current dampening systems is the sensitivity of the imaging member surface to temperature. Currently, fountain solution is applied to the imaging member surface via a vapor deposition system. Liquid fountain solution (e.g., D4—Octamethylcyclotetrasiloxane, D5—cyclopentasiloxane) is atomized into a flow of hot air (e.g., about 100° C.) and quickly converted into vapor. The fountain solution vapor/air mixture may then be ejected through a wide, thin nozzle or air knife at high velocity (e.g., about 7 m/s). When the hot vapor mixture meets the relatively cool imaging member surface, a thin uniform layer of liquid fountain solution condenses onto the surface. A containment shoe or baffle, positioned directly downstream of the fountain solution vaporizer in a rotating direction of the imaging member confines the ejected vapor close to the imaging member surface, thereby, improving the deposition dwell time and efficiency. The gap between the vapor air-knife or containment shoe and the imaging member surface is typically small (about 0.25-2 mm).

A problem with the vapor deposition approach of applying fountain solution is that the vaporizer and attached containment shoe are hot (e.g., about 100° C.). This heat radiates the cooler environment adjacent the vaporizer/containment shoe. Unfortunately, whenever the imaging member is stationary, a section of the imaging member surface is heated by the vaporizer/containment shoe unless the vaporizer/containment shoe is retracted a significant amount (e.g., at least about 75 mm) from the imaging member surface. This heated section of the imaging member surface does not condense the same amount of fountain solution vapor in comparison to other regions of the imaging member surface, which results in a significant image quality defect, for example an area of undesired solid ink coverage that does not represent an intended image.

Another drawback of the vapor deposition approach of applying fountain solution discussed above is its sensitivity to the temperature of the imaging member surface. The amount of fountain solution that condenses depends on the temperature of the adjacent imaging member surface. Therefore, if the imaging member surface temperature changes, the amount of deposited fountain solution changes. Accordingly, if the imaging member surface temperature is non-uniform, the amount of deposited fountain solution will be non-uniform.

Changes or non-uniformities of the deposited fountain solution layer directly impact image quality performance. To some extent, this impact may be expected and desired where laser patterning heats the top surface of the imaging member in a digital fashion. The laser used to generate the latent image in the fountain solution layer creates a localized high temperature region that is at about the boiling point of the dampening fluid, e.g., about 175° C. However, unintended non-uniformities in the imaging member surface temperatures are not desired. When used, for example, for multiple prints, even though the imaging member may be rotating in a more continuous manner transient heating may be induced by selective heating of the imaging member surface by a laser. The heat injected into the imaging member surface by the laser may not dissipate in one revolution and increases the surface temperature until a steady state temperature is achieved. The local increase in surface temperature reduces the condensation/deposition rate of the direct vaporization system of the "hot" blanket regions, thereby, causing local image defects.

The inventors have observed image quality artifacts with imaging member surface temperature non-uniformities of 2° C. To help avoid such image quality artifacts, imaging member surface temperature uniformity may be required at less than 2° C., less than 1° C. or even within about +/−0.5° C. across the entire blanket to ensure good imaging quality. This requirement may not be realized using related art vapor deposition systems.

In examples, an intermediate roller positioned between a vapor deposition system and an imaging member decouples the vapor deposition from the surface of the imaging member. The intermediate roller may be temperature controlled. A uniform layer of fountain solution will condense onto the surface of the temperature controlled intermediate roller regardless of the imaging blanket temperature. The fountain solution layer deposited onto the intermediate roller will split and deposit onto the imaging member surface. This condensate layer split may be independent of the temperature of the imaging member surface, resulting in a more uniform layer of fountain solution on the imaging blanket compared to the current direct condensation method when imaging member surface temperature variations are present.

Remotely locating the vaporizing chamber prevents the aforementioned heat transfer from the hot vaporizing chamber/shoe to the imaging member surface. Benefits of the examples include being able to put down a uniform layer of fountain solution condensate onto the imaging member reimageable surface to ensure no ghosting of subsequent prints. A thickness of the fountain solution layer may be preferably around 0.2 microns, or more broadly in a range of about 0.05 and about 0.5 microns. The intermediate roller allows for an even thickness layer of the fountain solution onto the imaging blanket which results in no ghosting image formation after multiple print cycles. It is understood that the terms dampening fluid and fountain solution are considered interchangeable.

FIG. 1 depicts an exemplary fountain solution deposition system 10 useful for printing with a digital image forming apparatus in accordance with the embodiments. The deposition system 10 may include an intermediate donor roller 12, a vapor supply chamber 14, a vapor baffle 16 and a vapor reclaim device 18. FIG. 1 shows the fountain solution deposition system 10 arranged with a digital imaging member 20 having a surface 22.

The imaging member surface 22 may be wear resistant and flexible. The surface 22 may be reimageable and conformable, having an elasticity and durometer, and sufficient flexibility for coating ink over a variety of different media types having different levels of roughness. A thickness of the reimageable surface layer may be, for example, about 0.5 millimeters to about 4 millimeters. The surface 22 should have a weak adhesion force to ink, yet good oleophilic wetting properties with the ink for promoting uniform inking of the reimageable surface and subsequent transfer lift of the ink onto a print substrate.

The soft, conformable surface 22 of the imaging member may include silicone. Other materials may be employed, including blends of polyurethanes, fluorocarbons, etc. The surface may be configured to conform to a print substrate on which an ink image is printed. To provide effective wetting of fountain solutions such as water-based dampening fluid, the silicone surface need not be hydrophilic, but may be hydrophobic. Wetting surfactants, such as silicone glycol copolymers, may be added to the fountain solution to allow the fountain solution to wet the silicone surface. The imaging member 20 may be a roll or drum, or may be a flat plate, surface of a belt, or other structure. The imaging member surface 22 may be temperature controlled to aid in a printing operation. For example, the imaging member 20 may be cooled internally (e.g., with chilled fluid) or externally (e.g., via a blanket chiller roll 38 (FIG. 2)) to aid in the image forming, transfer and cleaning operations of an image forming apparatus.

The donor roller 12 is an intermediate roll positioned in rolling communication with the imaging member surface 22. As such, the donor roller is configured to transfer fountain solution to the imaging member surface as the donor roller and imaging member rotate with each other. This rolling communication between the donor roller 12 and the imageable surface 22 of the rotatable imaging member 20 may be maintained regardless of whether the digital image forming apparatus is operating or the imaging member is rotating. While not being limited to a particular theory, the donor roller 12 may have a hard smooth surface 24 that interacts directly with the imageable surface 22 of the imaging member or that interacts indirectly with the imageable surface via one or more additional intermediate rollers. The donor roller 12 may be driven, for example, by a motor 25, or may be rotated via its rolling contact with the imaging member or another intermediate roller. While shown as a single roller, it is understood that the donor roller 12 may include a plurality of rollers.

The donor roller 12 may be temperate controlled to stabilize the rate or amount of fountain solution condensation onto the roller. For example, a coolant may flow within the donor roller as needed 12 to maintain the surface of the donor roller at a temperature (e.g., about 10° C.-60° C.) sufficiently lower than the fountain solution vapor temperature (e.g., at or above 100° C.) to condense the fountain solution vapor adjacent the donor roller onto the donor roller. The donor roller 12 may be made of a material having a high thermal conductivity (e.g., metal, stainless steel, chrome plated steel, aluminum, alloy). In examples the donor roller 12 may be a metal roller coated with a thin polymer layer (e.g., silicone, ethylene propylene diene monomer (EPDM), acrylonitrile butadiene rubber (NBR), hydrogenated acrylonitrile butadiene rubber (HNBR)). The thin polymer layer may be less than 1 mm thick.

The vapor supply chamber 14 may define a vapor supply chamber interior 26 within the chamber. The interior of the vapor supply chamber may contain fluid such as fluid solution vapor suitable for ink-based digital lithographic printing. The vapor supply chamber 14 includes an inlet 28 in fluid communication with a vapor source 35, such as a vapor generator, to enable flow of fountain solution vapor from the vapor source to the vapor supply chamber. The vapor supply chamber 14 descends towards the donor roller 12 to deliver fountain solution vapor from the vapor source 35 towards the surface 22 of the donor roller. Fountain solution vapor may be caused to flow in a direction of arrows A, through the vapor supply chamber 14, to the donor roller 12 for depositing onto the surface 22 of the donor roller, for example, at a vapor supply chamber outlet 30 configured to enable the vapor supply chamber interior to communicate with the surface of the donor roller. The vapor supply chamber may be configured in the shape of a tube or conduit, for example, to deposit dampening fluid vapor onto the surface 16 with uniform dampening fluid concentration, mixture velocity, and temperature.

The vapor supply chamber 14 may be made out of a material having a high thermal conductivity, such as metal (e.g., aluminum, stainless steel, alloy) and may be heated to help keep the fountain solution from condensing in the chamber. While not being limited to a particular theory, the vapor supply chamber 14 may be heated via a mechanical heater, for example, a heating element 54 in contact with the chamber. The heating element 54 may be a flexible heating element, such as a silicone heat pad, a silicone rubber/fiberglass heater, or polyimide heater. The heating element 54 may be bonded to the vapor supply chamber 14 via an adhesive or other mechanical fastening. For example, a silicone heat pad may be adhered to the exterior of the vapor supply chamber 14 with double sided pressure sensitive tape. The vapor supply chamber 14 could also be heated with cartridge heaters as the heating element. In examples, the vapor supply chamber may be heated to the temperature of the vapor/air mixture (e.g., about 100° C.). Of course the deposition system 10 is not limited to operate at vapor temps about 100° C. as it is understood by the inventors that operating the vapor supply chamber 14 at other temperatures (e.g., from about 60° C.-150° C. or hotter) would also work as intended.

Still referring to FIG. 1, a vapor baffle 16 may extend from the vapor supply chamber 14 adjacent and about the donor roller surface 22 to confine the fountain solution vapor provided from the vapor supply chamber outlet 30 to a condensation region 32 defined by the vapor baffle and the adjacent donor roller surface to support forming a layer of fountain solution liquid on the donor roller surface via condensation of the fountain solution vapor onto the donor roller surface. That is, the vapor baffle may define a vapor flow channel 34 with the donor roller surface as the condensation region 32. The vapor baffle may include arc walls 36 that face the donor roller surface, and boarder walls (not shown) that extend from the arc walls towards the donor roller surface. The arc walls 36 maybe spatially offset from the donor roller surface about 0.25-2 mm to form a gap there between. The vapor baffle 16 may be made out of a material having a high thermal conductivity, such as metal (e.g., aluminum, stainless steel, alloy) or other material that holds its shape around the donor roller 12 during operation of the deposition system 10.

Vapor condensation on the vapor baffle 16 may interfere with the uniformity of the layer of fluid solution condensate on the donor roller 12 and affect image quality. Thus it would be beneficial to minimize vapor condensation to the vapor baffle. In the examples, the vapor baffle 16 may be directly heated or conductively heated through contact with the heated vapor supply chamber 14. In a manner similar to the heating of the vapor supply chamber discussed above, the vapor baffle 16 may be directly heated via a mechanical heater, for example, a heating element 56 in contact with the baffle. The heating element 56 may be a flexible heating element, such as a silicone heat pad, a silicone rubber/fiberglass heater, or polyimide heater. The heating element 56 may be bonded to the vapor baffle 16 via an adhesive or other mechanical fastening. For example, a silicone heat pad may be adhered to the exterior of the vapor baffle 16 with double sided pressure sensitive tape. The vapor baffle could also be heated with cartridge heaters as the heating element. It is understood that the heating elements 54, 56 may be separate heaters, or combined as parts of one heater. The vapor baffle 16 may be heated to the temperature of the vapor/air mixture (e.g., about 100° C.), to the temperature of the vapor supply chamber, or more inclusively to temperatures from about 60° C. to 150° C. or hotter. While high thermal conductivity materials are discussed for the vapor supply chamber 14 and vapor baffle 16, it is understood that low thermal conductivity materials, such as plastics, fiberglass or composites may be used to help minimize condensation.

Figure 2:
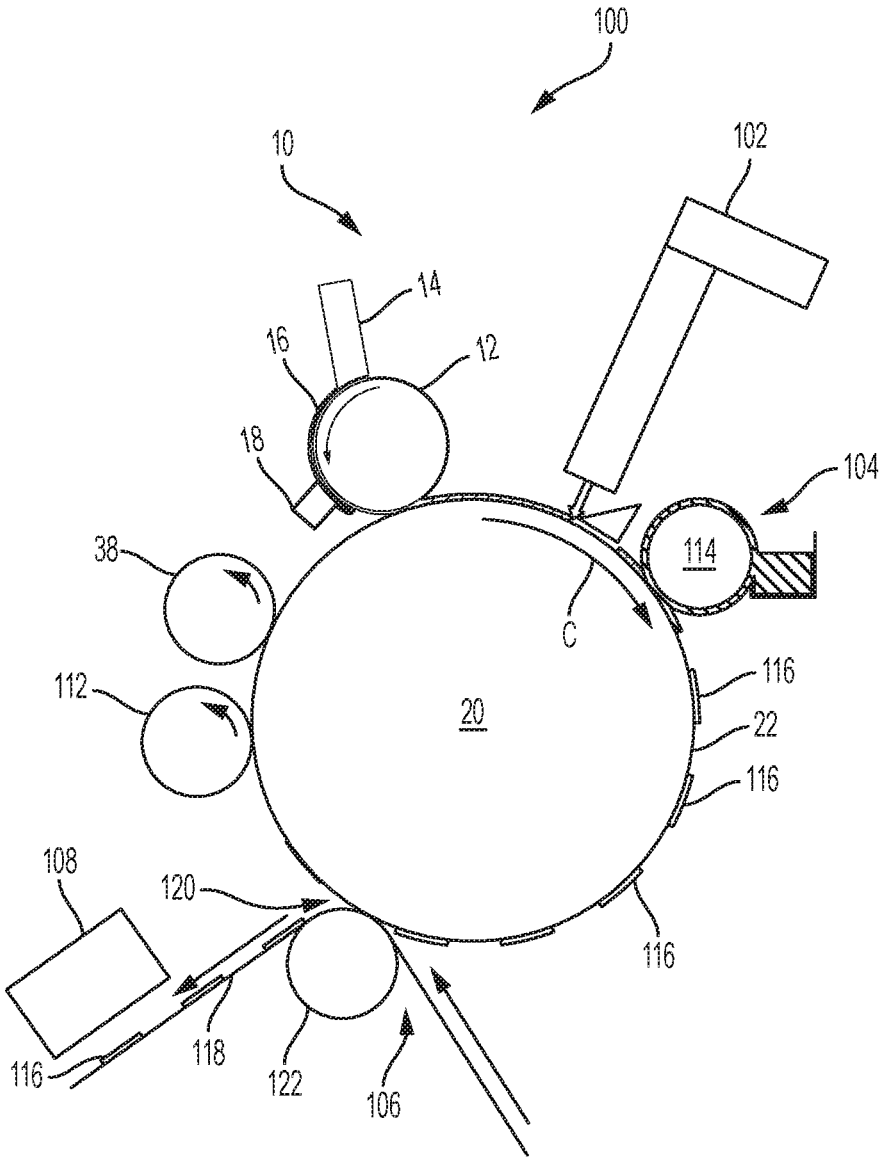
FIG. 2 is a block diagram of a digital image forming apparatus using the fountain solution deposition system illustrated by example in FIG. 1.

While not being limited to a particular configuration the vapor baffle 16 maybe in contact with the vapor supply chamber to avoid vapor leakage there between out of the condensation region 32. The vapor baffle 16 is shown in FIGS. 1 and 2 attached to the vapor supply chamber and extending about the donor roller surface 22 downstream the vapor supply chamber in a rotating direction of the donor roller indicated by arrows B. It is understood that the vapor baffle is not limited to one side of the vapor supply chamber and may also extend upstream and/or to other sides of the vapor supply chamber to confine the fountain solution vapor adjacent the donor roller for condensation of the fountain solution vapor exiting the vapor supply chamber outlet 30 onto the surface 22 as a layer of fountain solution condensate.

The fountain solution may be D4 or D5 dampening fluid. The fountain solution may include water optionally with small amounts of isopropyl alcohol or ethanol added to reduce surface tension as well as to lower evaporation energy necessary to support subsequent laser patterning, as will be described in greater detail below. Low surface energy solvents, for example volatile silicone oils, can also serve as fountain solutions.

It is contemplated that during operation some of the fountain solution vapor may not condensate into fountain solution liquid in the condensation region 32. To avoid leakage of this excess fountain solution vapor into the environment, the vapor reclaim vacuum may be added to the deposition system 10 to collect excess fountain solution. The vapor reclaim device 18 can be used to collect excess vapor at the exit of the vapor baffle 16. Reclaiming the excess vapor prevents fountain solution from depositing uncontrollably in the regions outside of the condensation region prior to the donor roller 12 and imaging member 20 interface. The vapor reclaim device 18 may also prevent fountain solution vapor from entering the environment. Reclaimed fountain solution vapor can be condensed, filtered and reused, reducing the overall use of fountain solution by the deposition system 10.

The vapor reclaim device 18 may have a vapor collection manifold 40 having an interior in fluid communication with a vacuum source. The vapor reclaim device 18 may be positioned downstream the vapor baffle 16 in the rotating direction of the donor roller 12 to remove the excess fountain solution vapor that does not condense over the donor roller surface 24 as it exits the condensation region 32. The manifold 40 may include a seal unit 42 that covers the donor roller surface 24 downstream the condensation region. The seal unit 42 preferably does not physically touch the donor roller surface as this may cause undesired friction with the donor roller 12, which rotates in the process direction B during printing. The seal unit 42 may include a shell wall 44 disposed adjacent the vapor baffle 16 over the surface 24 of the donor roller that extends towards the donor roller surface.

The shell wall 44 may be contoured over the vapor baffle 16 to define an excess vapor flow channel 46 there between that opens into a vapor extraction chamber 48 of the vapor collection manifold 40 having an interior 50 in fluid communication with a vacuum. As can be seen in FIG. 1, the excess vapor flow channel 46 may ascend away from the donor roller 12 to deliver the excess dampening fluid vapor from the donor roller surface 24 into the vapor extraction chamber interior 50. The vapor reclaim device may provide for condensation of the excess fountain solution vapor into a liquid state, with the fountain solution liquid then recycled back to the vapor source.

The fountain solution layer deposited onto the donor roller 12 splits and deposits onto the reimageable surface 22 of the imaging member 20 at a nip 52. This fountain solution fluid layer split occurs independent of temperature variation along the reimageable surface 22, resulting in a more uniform layer of fountain solution on the reimageable surface compared to current direct condensation methods when imaging member surface temperature variations are present. Such temperature variations due to digital laser imaging may be about 1° C. to 20° C., and may be greater than 20° C. The rotatable imaging member 20 may be rotated in a direction opposite the rotating direction of the donor roller 12, with the fountain solution on the donor roller spiting onto the reimageable surface 22 of the rotating imaging member. The donor roller 12 and rotatable imaging member 20 may remain in contact via their rolling communication at all times, regardless of whether a printing operation is occurring or the imaging member is rotating. Any fountain solution condensate remaining on the donor roller surface 24 after the splitting at the nip 52 may remain on the donor roller surface and can be combined with additional fountain solution liquid at the condensation region 32 for application to the reimageable surface 22 in a subsequent splitting at the nip.

FIG. 2 depicts a digital image forming apparatus 100 including the deposition system 10. The digital image forming apparatus may further include an optical patterning subsystem 102, an inker apparatus 104, an ink image transfer station 106, rheological conditioning subsystem 108 and a cleaning device 112. While FIGS. 1 and 2 show components that are formed as rollers, other suitable forms and shapes may be implemented.

The optical patterning subsystem 102 is located downstream the fountain solution deposition system 10 in the printing processing direction, which at this stage is the same direction of the imaging member rotation arrow C, to selectively pattern a latent image in the layer of fountain solution by image-wise patterning using, for example, laser energy. While the optical patterning subsystem 102 is shown as a laser emitter, it should be understood that a variety of different systems may be used to deliver the optical energy to pattern the fountain solution layer.

Following patterning of the fountain solution layer by the optical patterning subsystem 102, the patterned layer of fountain solution on the reimageable surface 22 is presented to the inker apparatus 104. The inker apparatus 104 is positioned downstream the optical patterning subsystem 102 to apply a uniform layer of ink over the patterned layer of fountain solution and the reimageable surface 22 of the imaging member. The inker apparatus 104 may deposit the ink to the evaporated pattern representing the imaged portions of the reimageable surface 22, while ink deposited on the unformatted portions of the fountain solution will not adhere based on a hydrophobic and/or oleophobic nature of those portions. The inker apparatus may heat the ink before it is applied to the surface 22 to lower the viscosity of the ink for better spreading into the imaged portion pockets of the reimageable surface. For example, at least one roller 114 of the inking apparatus may be heated, as well understood by a skilled artisan. The heated roller may be an anilox roll.

Downstream the inker apparatus 104 in the printing process direction resides the ink image transfer station 106 that transfers an ink image 116 from the imaging member surface 22 to a print substrate 118. The transfer occurs as the substrate 118 is passed through a transfer nip 120 between the imaging member 20 and an impression roller 122 such that the ink within the imaged portion pockets of the reimageable surface 22 is brought into physical contact with the substrate 118.

Rheological conditioning subsystem 108 may be used to increase the viscosity of the ink at specific locations of the digital image forming apparatus 100 as desired. While not being limited to a particular theory, the rheological conditioning subsystem 108 may include a curing mechanism, such as a UV curing lamp (e.g., standard laser, UV laser, high powered UV LED light source), wavelength tunable photoinitiator, or other UV source, that exposes the ink to an amount of UV light (e.g., # of photons radiation) to partially cure the ink to a tacky state. The curing mechanism may include various forms of optical or photo curing, thermal curing, electron beam curing, drying, or chemical curing. In the exemplary image forming apparatus 100 depicted in FIG. 2, a rheological conditioning subsystem 108 may be positioned adjacent the substrate 118 downstream the ink image transfer station 106 to cure the ink image transferred to the substrate.

This residual ink removal is most preferably undertaken without scraping or wearing the imageable surface of the imaging member. Removal of such remaining fluid residue may be accomplished through use of some form of the cleaning device 112 adjacent the surface 22 between the ink image transfer station 106 and the deposition system 10. Such a cleaning device may include at least a first cleaning member such as a sticky or tacky roller in physical contact with the imaging member surface 22, with the sticky or tacky member removing residual fluid materials (e.g., ink, fountain solution) from the surface. The sticky or tacky member may then be brought into contact with a smooth roller (not shown) to which the residual ink may be transferred from the sticky or tacky member, the ink being subsequently stripped from the smooth roller by, for example, a doctor blade or other like device and collected as waste. It is understood that the cleaning device 24 is one of numerous types of cleaning devices and that other cleaning devices designed to remove residual ink and fountain solution from the surface of a reimageable printing system imaging member are considered within the scope of the embodiments. For example, the cleaning device could include at least one roller, brush, web, belt, tacky roller, buffing wheel, etc., as well understood by a skilled artisan.

Figure 3:
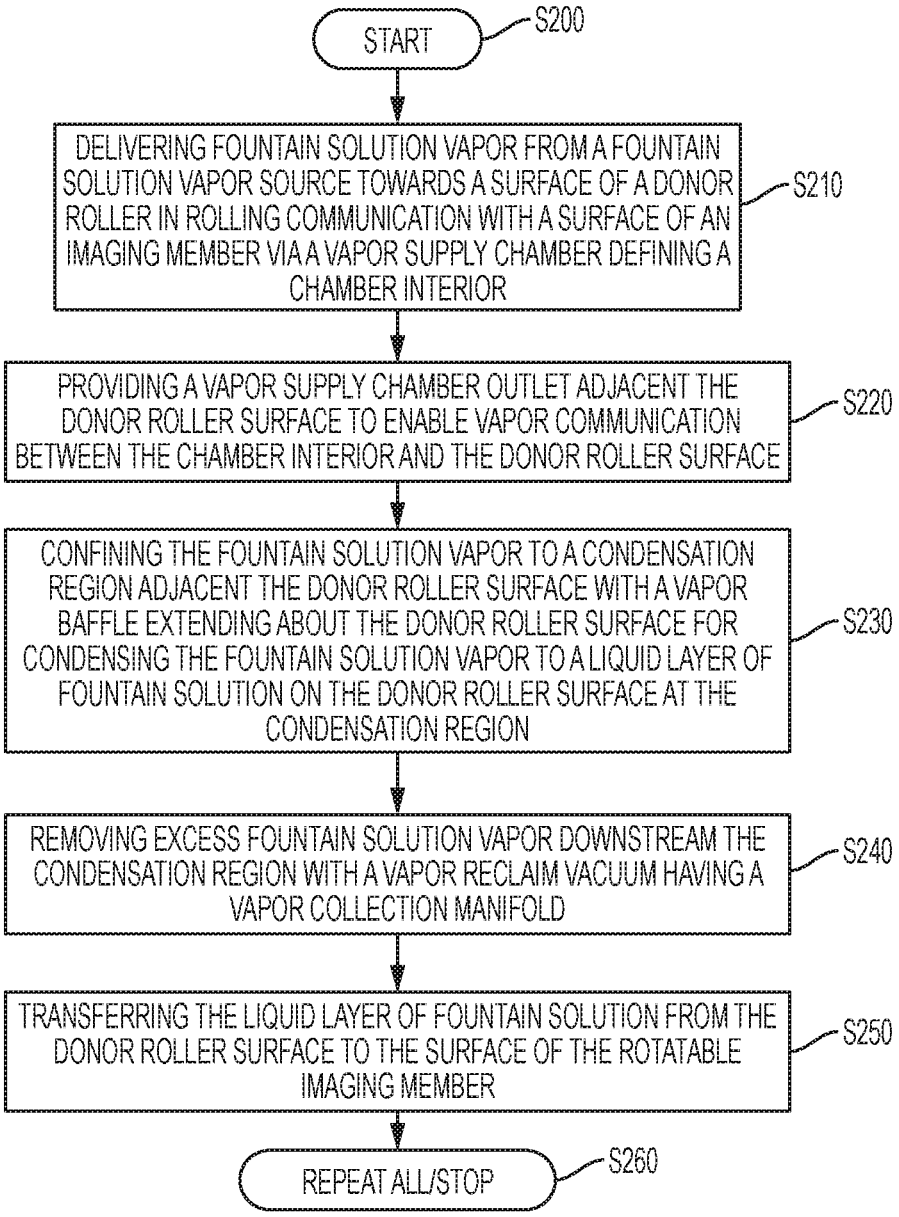
FIG. 3 is a flowchart depicting the operation of an exemplary fountain solution deposition system configured for use in a digital image forming apparatus.

The disclosed embodiments may include an exemplary method for depositing a condensate layer of fountain solution onto the reimageable surface 22 of the rotatable imaging member 20 useful for printing with a digital image forming apparatus. FIG. 3 illustrates a flowchart of such an exemplary method. As shown in FIG. 3, operation of the method commences at Step S200 and proceeds to Step S210.

At Step S210, fountain solution vapor from a vapor source is delivered towards the surface of a donor roller in rolling communication with the reimageable surface of the rotatable imaging member. The fountain solution vapor may be delivered via a vapor supply chamber defining a vapor supply chamber interior that is in fluid communication with the vapor source. The vapor supply chamber may descend towards the donor roller. Operation of the method proceeds to Step S220, where vapor communication between the vapor supply chamber interior and the donor roller surface is enabled by providing a vapor supply chamber outlet adjacent the donor roller surface. Operation of the method proceeds to Step S230.

At Step S230, the fountain solution vapor exiting the vapor supply chamber interior is confined to a condensation region adjacent the donor roller surface by a vapor baffle in contact with the vapor supply chamber and extending about the donor roller surface downstream the vapor supply chamber in a rotating direction of the donor roller. The vapor baffle may be spatially located about 0.25-2 mm away from the donor roller surface to form a gap defining the condensation region. The confined fountain solution vapor condenses in the condensation region to form a liquid layer of fountain solution on the donor roller surface in the gap. The temperature of the donor roller surface may be controlled to a temperature about 10° C.-60° C. to promote condensation of the hot fountain solution vapor (e.g., about 100° C.) onto the cooler donor roller surface.

Operation of the method may proceed to Step S240, where excess fountain solution vapor downstream the condensation region in the rotating direction of the donor roller is removed with a vapor reclaim vacuum having a vapor collection manifold downstream the vapor baffle in a rotating direction of the donor roller. The excess fountain solution vapor includes the fountain solution vapor that does not condense to the liquid layer of fountain solution in the condensation region. Operation of the method proceeds to Steps S250.

At Step S250, the condensate layer of fountain solution is transferred from the donor roller surface to the reimageable surface of the rotatable imaging member at a nip there between. The rotatable imaging member may be rotated in a direction opposite the rotating direction of the donor roller while the ink-based digital image forming apparatus is performing a printing operation, with the fountain solution on the donor roller spiting onto the reimageable surface of the rotating image member. The donor roller and rotatable imaging member may remain in contact via their rolling communication at all times, regardless of whether a printing operation is occurring. Any fountain solution condensate remaining on the donor roller surface after the splitting at the nip may remain on the donor roller surface and be combined with additional fountain solution liquid during a next rotation at the condensation region for application to the reimageable surface in a subsequent splitting at the nip. Operation may cease at Step S260, or may continue by repeating back to Step S210, where more fountain solution vapor from a vapor source is delivered towards the surface 24 of the donor roller.

The exemplary depicted sequence of executable method steps represents one example of a corresponding sequence of acts for implementing the functions described in the steps. The exemplary depicted steps may be executed in any reasonable order to carry into effect the objectives of the disclosed embodiments. No particular order to the disclosed steps of the method is necessarily implied by the depiction in FIG. 3, and the accompanying description, except where any particular method step is reasonably considered to be a necessary precondition to execution of any other method step. Individual method steps may be carried out in sequence or in parallel in simultaneous or near simultaneous timing. Additionally, not all of the depicted and described method steps need to be included in any particular scheme according to disclosure.

Those skilled in the art will appreciate that other embodiments of the disclosed subject matter may be practiced with many types of image forming elements common to offset inking system in many different configurations. For example, although digital lithographic systems and methods are shown in the discussed embodiments, the examples may apply to analog image forming systems and methods, including analog offset inking systems and methods. It should be understood that these are non-limiting examples of the variations that may be undertaken according to the disclosed schemes. In other words, no particular limiting configuration is to be implied from the above description and the accompanying drawings.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A fountain solution deposition system useful for printing with an ink-based digital image forming apparatus having a rotatable imaging member with a reimageable surface and a donor roller having a surface in rolling communication with the reimageable surface of the rotatable imaging member, the system comprising:

a vapor supply chamber defining a vapor supply chamber interior in fluid communication with a fountain solution vapor source, the vapor supply chamber adjacent the donor roller, the vapor supply chamber being configured to deliver fountain solution vapor from the fountain solution vapor source towards the surface of the donor roller;

a vapor supply chamber outlet configured to enable the vapor supply chamber interior to communicate with the surface of the donor roller; and a vapor baffle in contact with the vapor supply chamber and extending about the donor roller surface downstream the vapor supply chamber in a rotating direction of the donor roller defining a vapor flow channel with the donor roller surface to confine the fountain solution vapor to a gap region between the vapor baffle and the donor roller surface to support forming a layer of fountain solution on the donor roller surface via transfer of the fountain solution vapor onto the donor roller surface, the donor roller adapted to transfer the layer of fountain solution from the donor roller surface to the reimageable surface of the rotatable imaging member.

2. The system of claim 1, further comprising a vapor reclaim vacuum having a vapor collection manifold downstream the vapor baffle in a rotating direction of the donor roller, the vapor reclaim vacuum configured to remove fountain solution vapor downstream the gap region.

3. The system of claim 1, further comprising a heater configured to heat at least one of the vapor supply chamber and the vapor baffle.

4. The system of claim 1, wherein the gap region is a condensation region configured to support forming the layer of fountain solution on the donor roller surface via condensation of the fountain solution vapor over the donor roller surface.

5. The system of claim 1, further comprising the donor roller having the surface in rolling communication with the reimageable surface of the rotatable imaging member.

6. The system of claim 5, wherein the donor roller is configured to maintain the rolling communication with the reimageable surface of the rotatable imaging member regardless of a rotation of the imaging member.

7. A method for depositing a layer of fountain solution onto a reimageable surface of a rotatable imaging member useful for printing with an ink-based digital image forming apparatus, comprising:

delivering fountain solution vapor from a fountain solution vapor source towards a surface of a donor roller in rolling communication with the reimageable surface of the rotatable imaging member via a vapor supply chamber defining a vapor supply chamber interior in fluid communication with the fountain solution vapor source, the vapor supply chamber being adjacent the donor roller;

providing a vapor supply chamber outlet adjacent the donor roller surface to enable vapor communication between the vapor supply chamber interior and the donor roller surface;

confining the fountain solution vapor to a gap region adjacent the donor roller surface with a vapor baffle in contact with the vapor supply chamber and extending about the donor roller surface downstream the vapor supply chamber in a rotating direction of the donor roller, the confined fountain solution vapor transferring onto the donor roller surface at the gap region as the layer of fountain solution; and transferring the layer of fountain solution from the donor roller surface to the reimageable surface of the rotatable imaging member.

8. The method of claim 7, further comprising removing excess fountain solution vapor downstream the gap region in the rotating direction of the donor roller with a vapor reclaim vacuum having a vapor collection manifold downstream the vapor baffle in a rotating direction of the donor roller, the excess fountain solution vapor including the fountain solution vapor that does not transfer onto the layer of fountain solution in the gap region.

9. The method of claim 7, the confining step further comprising forming the layer of fountain solution on the donor roller via condensation of the fountain solution vapor over the donor roller surface.

10. The method of claim 7, further comprising rotating the donor roller with a motor.

11. The method of claim 7, the step of confining the fountain solution vapor to the gap region including providing the vapor baffle spatially about 0.25-2 mm away from the donor roller surface to form a gap defining the gap region.

12. The method of claim 11, further comprising maintaining the gap regardless of whether the ink-based digital image forming apparatus is performing the printing operation.

13. The method of claim 7, further comprising rotating the rotatable imaging member in a direction opposite the rotating direction of the donor roller while the ink-based digital image forming apparatus is performing a printing operation.

14. The method of claim 11, further comprising maintaining the rolling communication between the donor roller and the reimageable surface of the rotatable imaging member regardless of a rotating of the imaging member.

15. A fountain solution deposition system useful for printing with an ink-based digital image forming apparatus having a rotatable imaging member with a reimageable surface, the system comprising:

a conductive donor roller having a surface in rolling communication with the reimageable surface of the rotatable imaging member;

a vapor supply chamber defining a vapor supply chamber interior in fluid communication with a fountain solution vapor source, the vapor supply chamber descending towards the conductive donor roller, the vapor supply chamber being configured to deliver vapor from the fountain solution vapor source towards the surface of the conductive donor roller;

a vapor supply chamber outlet configured to enable the vapor supply chamber interior to communicate with the surface of the conductive donor roller; and a vapor baffle in contact with the vapor supply chamber and extending about the surface of the conductive donor roller downstream the vapor supply chamber in a rotating direction of the conductive donor roller defining a vapor flow channel with the surface of the conductive donor roller to confine the fountain solution vapor to a gap region between the vapor baffle and the surface of the conductive donor roller to support forming a layer of fountain solution on the surface of the conductive donor roller via transfer of the fountain solution vapor over the surface of the conductive donor roller, the conductive donor roller configured to transfer the layer of fountain solution from the surface of the conductive donor roller onto the reimageable surface of the rotatable imaging member, wherein the fountain solution passes through the vapor supply chamber and the vapor baffle for transfer of the vapor onto the surface of the conductive donor roller.

16. The system of claim 15, further comprising a vapor reclaim vacuum having a vapor collection manifold downstream the vapor baffle in a rotating direction of the conductive donor roller, the vapor reclaim vacuum configured to remove fountain solution vapor downstream the gap region.

17. The system of claim 15, wherein the gap region is a condensation region configured to support forming the layer of fountain solution on the surface of the conductive donor roller via condensation of the fountain solution vapor over the surface of the conductive donor roller.

18. The system of claim 15, wherein the conductive donor roller is motor driven.

19. The system of claim 15, wherein the vapor flow channel forms a gap between the vapor baffle and the surface of the conductive donor roller of about 0.25-2 mm.

20. The system of claim 15, wherein the conductive donor roller is configured to maintain the rolling communication with the reimageable surface of the rotatable imaging member regardless of a rotation of the imaging member.

* * * * *